US006249973B1

(12) United States Patent
Hirano

(10) Patent No.: US 6,249,973 B1
(45) Date of Patent: Jun. 26, 2001

(54) THINNING RAZOR

(75) Inventor: Toru Hirano, Tokyo (JP)

(73) Assignee: Tokyo Riki Co., Ltd., Tokyo (JP)

( * ) Notice: Subject to any disclaimer, the term of this patent is extended or adjusted under 35 U.S.C. 154(b) by 0 days.

(21) Appl. No.: 09/444,842

(22) Filed: Nov. 22, 1999

(51) Int. Cl.[7] ..... B26B 21/12

(52) U.S. Cl. ..... 30/30; 30/54; 30/55; 30/63; 30/79; 30/335

(58) Field of Search ..... 30/30, 54, 55, 30/62, 63, 75, 79, 335, 338

(56) References Cited

U.S. PATENT DOCUMENTS

| | | | | |
|---|---|---|---|---|
| 1,197,364 | * | 9/1916 | Fuller | 30/54 |
| 2,536,485 | * | 1/1951 | Behr | 30/30 |
| 2,650,421 | * | 9/1953 | Wietzel | 30/30 |
| 2,979,818 | * | 4/1961 | Bakarich | 30/30 |
| 3,409,981 | * | 11/1968 | Beverly | 30/30 |
| 3,613,233 | * | 10/1971 | Lundell | 30/30 |
| 3,805,381 | | 4/1974 | Broussard, Sr. . | |
| 4,441,252 | | 4/1984 | Caves . | |
| 5,461,780 | | 10/1995 | Morana . | |
| 6,094,820 | * | 8/2000 | Adachi | 30/30 |

FOREIGN PATENT DOCUMENTS

| | | |
|---|---|---|
| 8-309045 | 11/1996 | (JP) . |
| 11-90060 | 4/1999 | (JP) . |

* cited by examiner

*Primary Examiner*—Boyer Ashley
(74) *Attorney, Agent, or Firm*—Oblon, Spivak, McClelland, Maier & Neustadt, P.C.

(57) ABSTRACT

A mechanical thinning razor includes a shank, a handle, a blade, a bladeguard, a driving member and a sliding member. When pushing an external surface of the driving member toward a hollow midsection of the shank, the bevel of the driving member forces the sliding member to move longitudinally over a distance that corresponds to a width of exposed segments or non-exposed segments, thereby doubling the working life of the blade.

11 Claims, 8 Drawing Sheets

THINNING RAZOR

BACKGROUND OF THE INVENTION

1. Field of the Invention

The present invention relates to a thinning razor, and more specifically it relates to a purely mechanical thinning razor that includes a driving member and a sliding member.

2. Discussion of Background

One of the essential tools of barbers and hair stylists is a razor. Originally meant for shaving facial hair and trimming of the hairline at the back of the head, the razor has undergone substantial changes in its structure and use over the years. A typical example is a practical device called a 'thinning razor' (also 'hair trimming device'), which purpose basically compares to that of the traditional thinning shears, namely to thin out strands of hair so that a less voluminous look can be created. Contrary to the thinning shears, the thinning razor achieves a smooth and elegant appearance of the hair, the reason being that separated strands of hair are shaved in a downward direction over an angle that conforms with the natural flow of one's hair. Essentially, the thinning razor consists of a blade which cutting edge is shielded by an array of comb-like teeth. Its basic concept is not new and appears in various patent publications, such as those identified below.

U.S. Pat. No. 4,441,252 (Caves '84) discloses a hair trimming device that includes a conventional double-edged razor blade, two base plate members and a handle. The base plate members are joined to one another by pegs so as to form a housing which holds the blade sandwiched between. The base plate members are provided with cut away portions which form comb-like teeth therebetween. The handle comprises two arms each having a recess. These recesses snap on projecting ridge members so as to hold the housing between the arms.

Additionally, U.S. Pat. No. 5,461,780 (Morana '95) discloses a do-it-yourself handleless hair trimming device that comprises a plurality of conventional razor blades, a base element and a backing element. The base element and backing element are joined to one another by thumb screws and cup nuts so as to form a housing which holds the blades sandwiched between. The base element is provided with comb-like teeth of different lengths.

The devices described in both U.S. Pat. No. 4,441,252 and U.S. Pat. No. 5,461,780 are evidently not meant to be used by professional barbers or hair stylists since the following characteristics are not convincingly addressed:

a) the prospect of quick and safe blade replacement, b) economic usage of the entire blade, c) alternative methods of use, and d) a convenient grip.

However, U.S. Pat. No. 3,805,381 (Broussard '74), discloses a hair styling device that includes a handle, a means for cutting, a means for combing and a push button means. The handle is tapered into a free end for use as a hair divider. The means for cutting comprises a blade which is held by a blade holder, with the blade holder being fixed to a recess having angular serrations. The push button means is slidably mounted in a slot and inscribed with an arrow. When the blade is fully inserted into the blade holder, the arrow coincides with a base index mark. Adjacent to this base index mark is a second index mark and the distance between these two marks corresponds to the width of a serration. On that account, when aligning the arrow with the second index mark by sliding the push button, the portions of the blade originally positioned behind the serrations become exposed. This doubles the working life of the blade. The push button means is also adapted to slide the blade out of the blade holder so that a new blade can be inserted.

Although the working life of the blade in U.S. Pat. No. 3,805,381 is doubled, the mechanism of the push button means in relation to the means for cutting is awkward, in that the user must focus on a small part of the device in order to precisely align the arrow with the second index. Also, its unusual design especially of the tapered handle makes holding and operating the device rather discomforting.

Japanese Unexamined Patent Publication No. 090060/1999 (Adachi Kogyo Ltd. '99) discloses a razor holder comprising a handle, a razor insertion part and a replaceable razor. The holder is provided with a hole through which the user's finger can be inserted in order to facilitate operation. The replaceable razor which is inserted and held by the insertion part has, as part of its structure, comb-like teeth.

Japanese Unexamined Patent Publication No. 309045/1996 (Adachi Kogyo Ltd. '96) discloses a thinning razor identical to the one disclosed in Japanese Unexamined Patent Publication No. 090060/1999, except that the replaceable razor is provided with a small window through which the blade can be moved in a lengthwise direction so that unexposed parts of the blade become exposed, thus doubling its working life.

Nevertheless, production costs and subsequent retail prize of both replaceable razors described above are considerable high, on top of which, the device disclosed in Japanese Unexamined Patent Publication No. 090060/1999 does not even use the entire length of its blade.

SUMMARY OF THE INVENTION

It is an object of the present invention to provide a thinning razor being adaptable to use common—inexpensive to manufacture replacement blades.

It is a further object of the present invention to provide a thinning razor being adaptable to double the working life of its blade.

In order to achieve these object, the thinning razor according to the present invention typically comprises a shank, a handle, a blade, a bladeguard, a driving member and a sliding member. The shank has a longitudinal direction, with one end being a front end and the opposite end being a rear end. Between the front end and the rear end, the shank is provided with a hollow midsection. The front end of the shank comprises an opening which extends toward the hollow midsection of the shank to form an elongated slot and the rear end of the shank is attached to the handle.

Since the front end of the shank comprises an opening which extends toward the hollow midsection of the shank to form an elongated slot, a single-edged blade can be inserted into the opening and slidably pushed toward the hollow midsection of the shank until the blade can move no further and is held inside the elongated slot.

With the shank and blade as described above, it is possible to use the thinning razor according to the present invention in combination with any common replacement blade, providing that such blade is an ordinary thin strip of metal having one long edge machined in such a way that this long edge is extremely sharp and that the length of the blade is about the same length of the elongated slot. A blade as described above is inexpensive because a minimum of manufacturing steps and a minimum of material is required.

The bladeguard extends lengthwise of the blade and comprises an array of comb-shaped teeth. These comb-shaped teeth abut on one side of the cutting edge of the single-edged blade. By adopting such a structure, the comb-shaped teeth cover alternate segments of the cutting edge of the single-edged blade so that the cutting edge has exposed segments and non-exposed segments.

The driving member is positioned inside the hollow midsection of the shank. This driving member is manufactured so that one of its surfaces is a bevel and another one of its surfaces constitutes an external surface, with the bevel adjoining the external surface.

The sliding member is positioned between the blade and the driving member.

As described previous, the thinning razor of the present invention comprises among others, a driving member and a sliding member. The driving member is positioned inside the hollow midsection of the shank and the sliding member is positioned between the inserted blade and the driving member.

When pushing the external surface of the driving member toward the hollow midsection of the shank, the bevel of the driving member pushes against the sliding member and forces the sliding member to move in the lengthwise direction toward the opening at the front end of the shank. The sliding member moves over a distance that corresponds to a width of either said exposed segments or said non-exposed segments.

The relationship between the driving member and the sliding member as described above provides for a thinning razor having a single-edged blade with the non-exposed segments of the sharp edge becoming exposed when merely pushing the exposed surface of the driving member, thereby doubling the working life of the blade.

BRIEF DESCRIPTION OF THE DRAWINGS

Other objects, structural features and advantages of the present invention are explained in further detail by referring to the attached drawings illustrating preferred embodiments of the present invention.

DETAILED DESCRIPTION OF THE PREFERRED EMBODIMENTS

Figure 1:
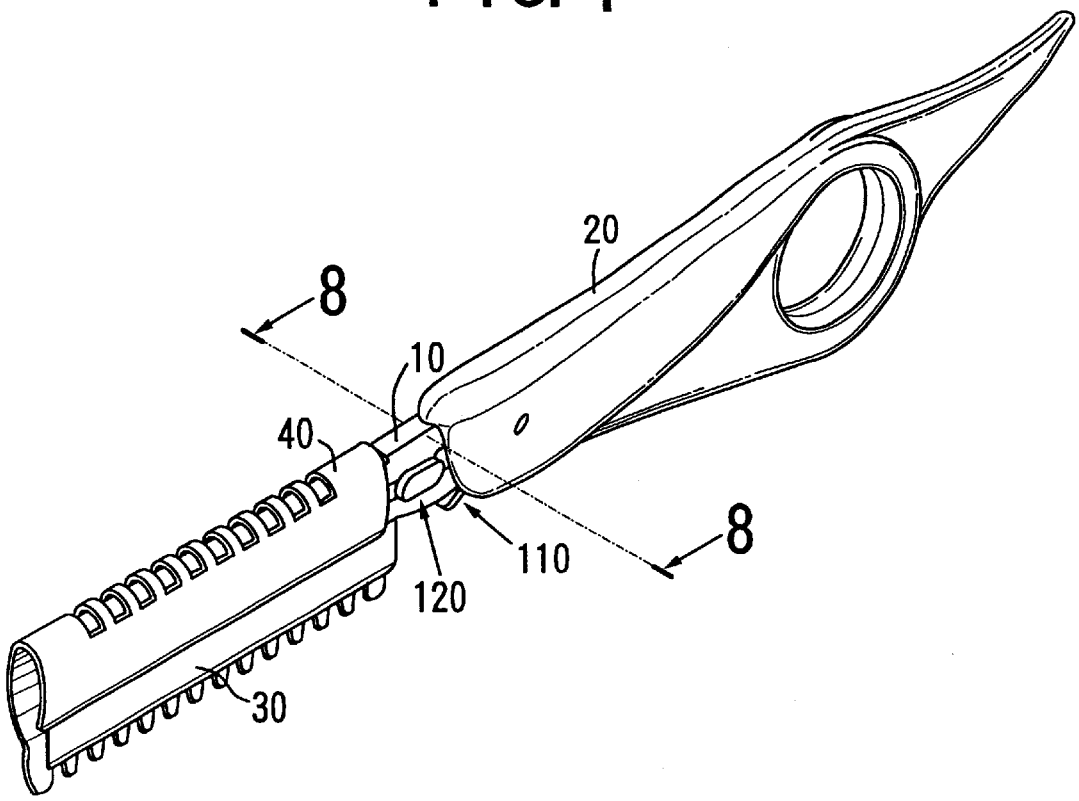
FIG. 1 is a perspective view of the thinning razor according to the present invention.

Referring to FIG. 1, the thinning razor according to the present invention includes a shank (10), a handle (20), a blade (30), a bladeguard (40), a driving member (110) and a sliding member (120).

Figure 2:
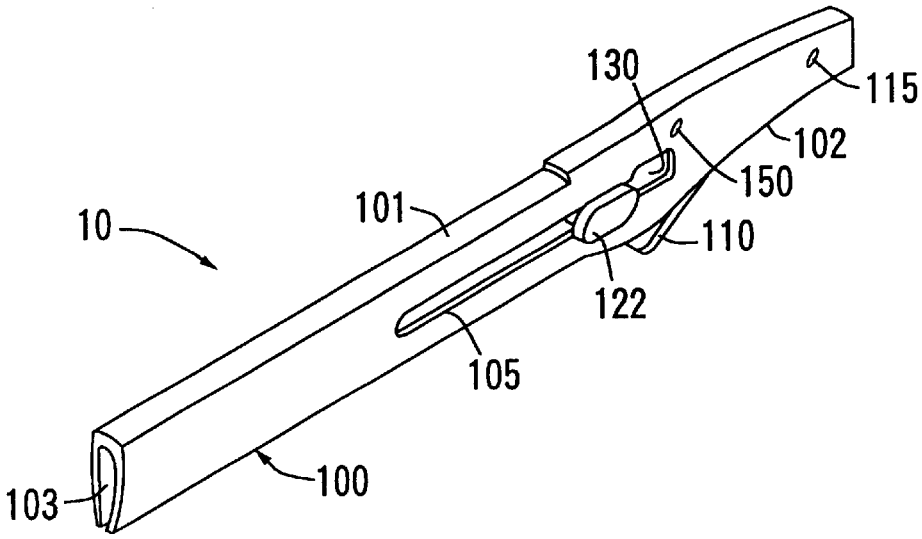
FIG. 2 is a slightly enlarged perspective view illustrating the shank of the thinning razor according to the present invention.

FIG. 2 illustrates the shank (10) of the thinning razor according to the present invention. The shank (10) has a longitudinal direction which extends from a front end to an opposite rear end and has an upper surface (101) and a lower surface (102). Formed between the front end and rear end is a hollow midsection (130) being open at the lower surface (102). The front end of the shank (10) is provided with an opening (103). This opening (103) extends from the front end to the hollow midsection (130) and is open in the longitudinal direction at the lower surface (102) of the shank (10), so as to form elongated slot (100). The rear end of the shank (10) is provided with a throughhole (115).

Figure 3:
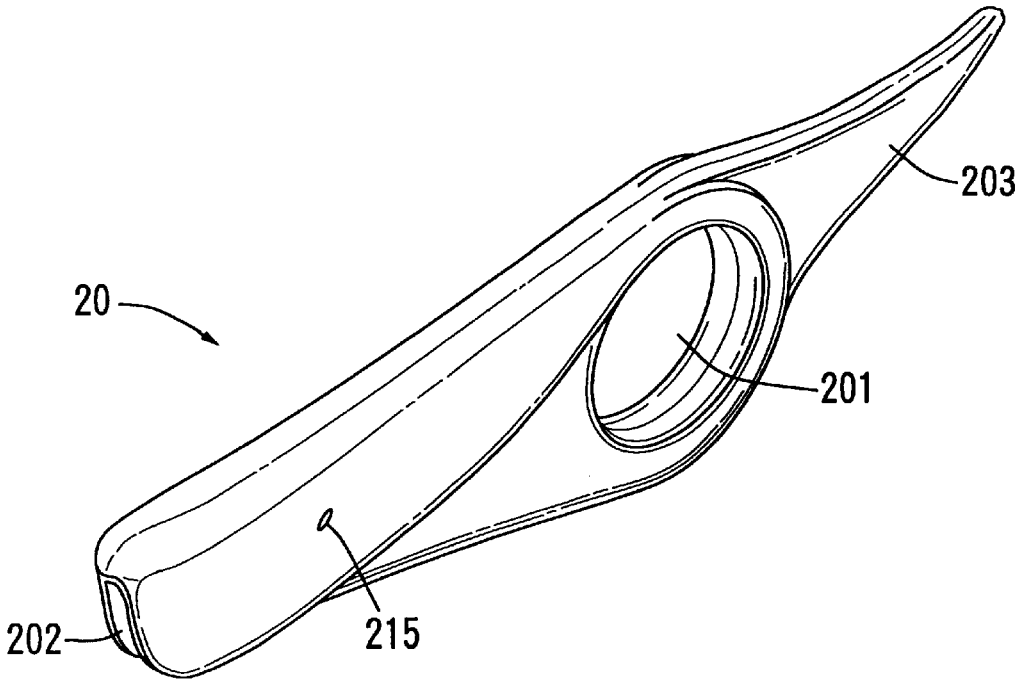
FIG. 3 is a slightly enlarged perspective view illustrating the handle of the thinning razor according to the present invention.

FIG. 3 illustrates the handle (20) of the thinning razor according to the present invention. The handle (20) of the thinning razor has a longitudinal direction and extends from a front end to an opposite rear end, with the front end having an opening (202) and being provided with a throughhole (215). The rear end of the shank (10) is inserted into the opening (202) of the handle (20) so that throughhole (215) of the handle (20) is aligned with throughhole (115) of the shank (10). The handle (20) and the shank (10) are secured by a single pin which is inserted in the throughholes (215) and (115).

Figure 4:
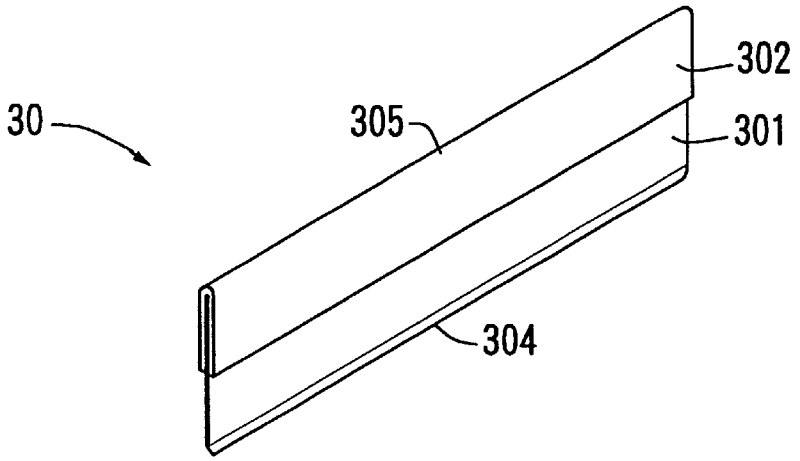
FIG. 4 is a slightly enlarged perspective view illustrating the blade of the thinning razor according to the present invention

FIG. 4 illustrates the blade (30) of the thinning razor according to the present invention. The blade (30) includes a thin metal strip (301) machined in a customary way, so that one of its longer edges constitutes a sharp cutting edge (304).

For the purpose of reinforcing the blade (30), a backing strip (302) is folded over a longer edge opposing the cutting edge (304) and plated or otherwise attached thereonto. The edge opposite the cutting edge (304) constitutes a turned-up edge (305). With a blade as described above, it is possible to use the thinning razor according to the present invention in combination with any common replacement blade, providing that such blade is an ordinary thin strip of metal having one long edge machined in such a way that this long edge is extremely sharp and that the length of the blade is about the same length of the elongated slot (100). It is obvious that the manufacturing cost of such a blade can be kept low because a minimum of manufacturing steps and a minimum of material is required.

As explained earlier, the shank (10) is provided with an opening (103) and this opening (103) extends from the front end to the hollow midsection (130) and is open in the longitudinal direction at the lower surface (102) of the shank (10), so as to form elongated slot (100). The blade (30) can thus be inserted into the opening (103) of the shank (10) and slidably pushed all the way into the elongated slot (100).

Figure 5:
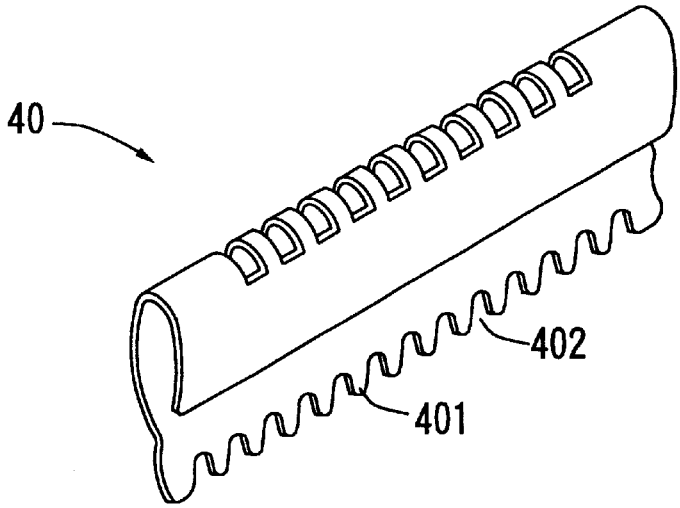
FIG. 5 is a slightly enlarged perspective view illustrating the bladeguard of the thinning razor according to the present invention.

FIG. 5 illustrates the bladeguard (40) of the thinning razor according to the present invention. One longitudinal edge of the bladeguard (40) is provided with an array of comb-shaped teeth (401) having therebetween gaps (402).

Figure 6:
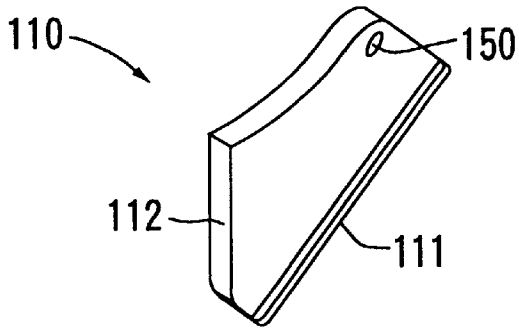
FIG. 6 is a slightly enlarged perspective view illustrating the driving member of the thinning razor according to the present invention.

FIG. 6 illustrates the driving member (110) of the thinning razor according to the present invention. The driving member (110) is manufactured so that one of its surfaces is a bevel (112) and another one of its surfaces constitutes an external surface (111), with the bevel (112) adjoining the external surface (111). In order for the driving member (110) to be able to swivel, a pivot (150) is provided.

The driving member (110) is positioned inside the hollow midsection (130) of the shank (10) and swivels around pivot (150) (see FIG. 2). The bevel (112) and the external surface (111) continuously adjoin one another, with the external surface (111) facing opposite the lower surface (102) of the shank (10).

Figure 7:
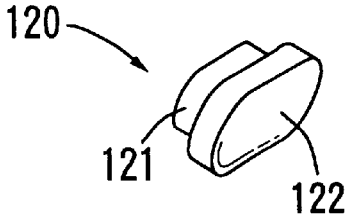
FIG. 7 is a slightly enlarged perspective view illustrating the sliding member of the thinning razor according to the present invention.

FIG. 7 illustrates the sliding member (120) of the thinning razor according to the present invention. The sliding member (120) consists of an internal portion (121) and an external portion (122). The sliding member (120) is positioned inside the hollow midsection (130) of the shank (10) and positioned between the inserted blade (30) and the driving member (110) (see FIG. 2).

Figure 8:
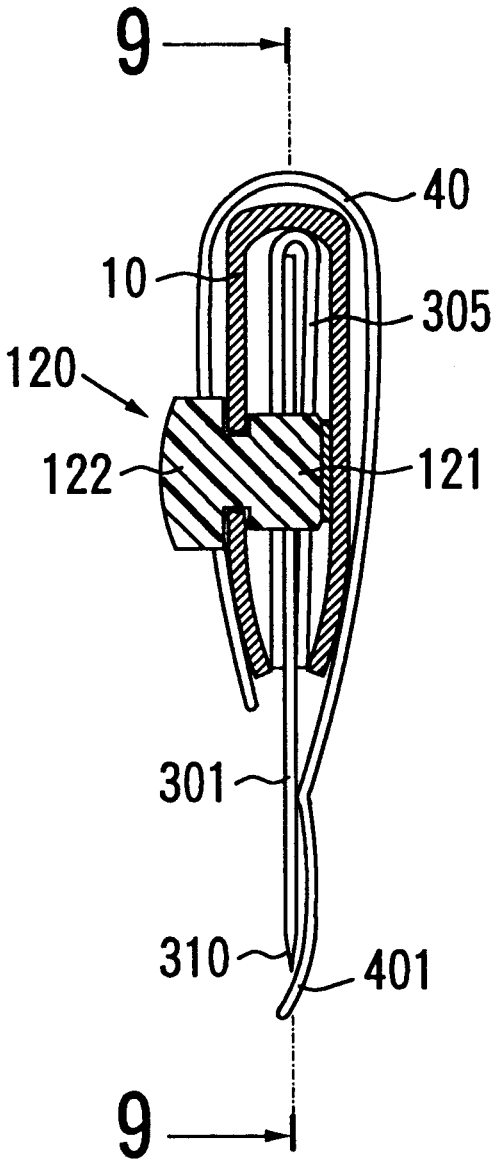
FIG. 8 is a sectional view of the thinning razor according to the present invention, taken along lines 8—8 of FIG. 1.

FIG. 8 is a sectional view taken along lines 8—8 in FIG. 1 and further illustrates the relationship between the sliding member (120), shank (10), blade (30) and bladeguard (40).

Figure 9:
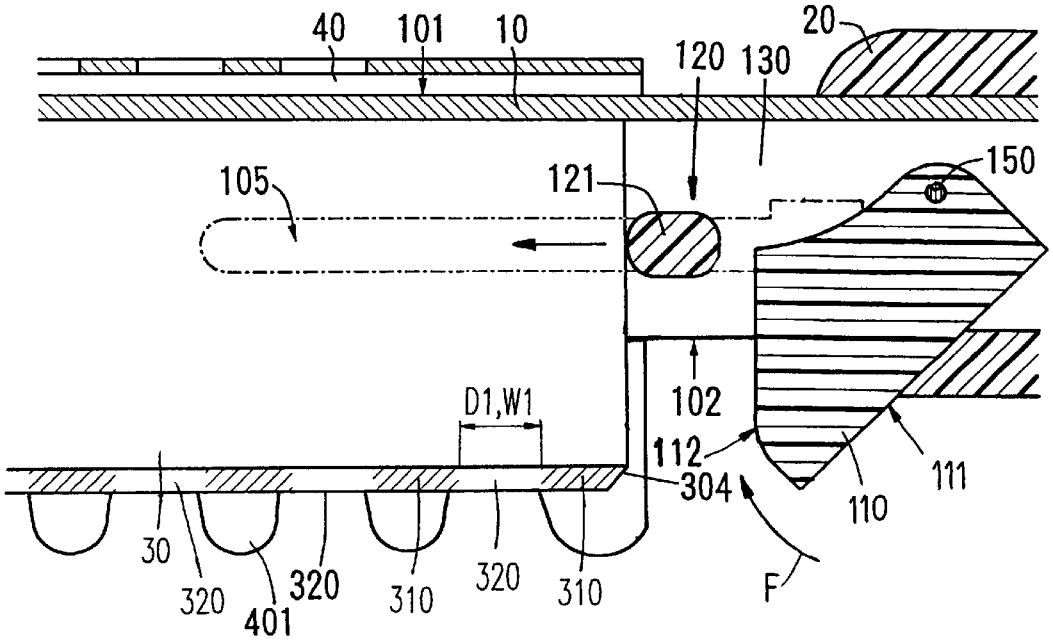
FIG. 9 is an enlarged sectional view taken along lines 9—9 of FIG. 8, illustrating the relationship between the driving member, sliding member and the blade prior to pushing the external surface of the driving member toward the hollow midsection of the shank
Figure 10:
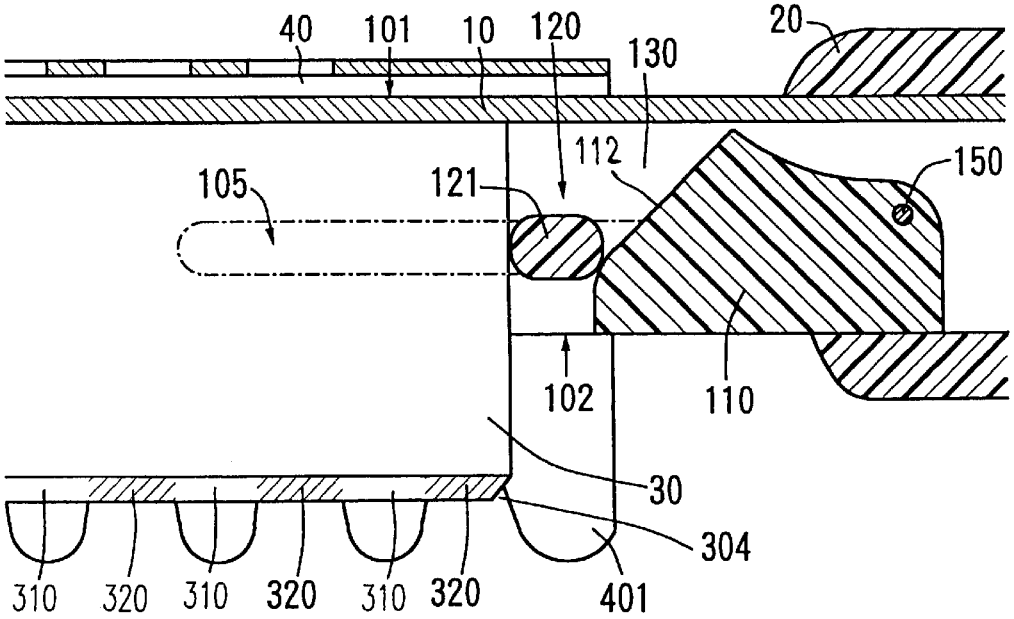
FIG. 10 illustrates the embodiment of the thinning razor as shown in FIG. 9 after pushing the external surface of the driving member toward the hollow midsection of the shank.

Referring now to FIGS. 9 and 10, the purpose, relationship and function of the driving member (110) and the sliding member (120) are explained.

FIG. 9 is illustrates the relationship between the driving member (110), sliding member (120) and the blade (30) prior to pushing the external surface (111) of the driving member (110) toward the hollow midsection (130) of the shank (10), and FIG. 10 illustrates the relationship between the driving member (110), sliding member (120) and the blade (30) after pushing the external surface (111) of the driving member (110) toward the hollow midsection (130) of the shank (10).

As described earlier, the bladeguard (40) of the thinning razor according to the present invention has one longitudinal edge provided with an array of comb-shaped teeth (401) having therebetween gaps (402). These comb-shaped teeth (401) abut onto one side of the the cutting edge (304). By adopting such a structure, the comb-shaped teeth (401) cover alternate segments of the cutting edge (304) of the single-edged blade (30) so that the cutting edge (304) has non-exposed segments (310) and exposed segments (320).

After using the thinning razor according to the present invention for a nonspecific period of time, the exposed segments (320) of the cutting edge (304) will eventually lose sharpness and become blunt. At that time, it is possible and essential to expose the non-exposed segments (310) of the cutting edge (304). This can be done by simply pressing one's thumb or any 7 other finger against the external surface (111) of the driving member (110) and push the external surface (111) toward the hollow midsection (130) of the shank (10) until the external surface (111) lies parallel to the lower surface (102) of the shank (10), as illustrated in FIG. 10.

In order to achieve the above-mentioned exposing of non-exposed segments (310) of the cutting edge (304), the thinning razor comprises among others, a driving member (110) and a sliding member (120). The driving member (110) is positioned inside the hollow midsection (130) of the shank (10) and the sliding member (120) is positioned between the inserted blade (30) and the driving member (110). The sliding member (120) has an internal portion (121) inside the hollow midsection (130) of the shank (10) and an external portion (122) outside the hollow midsection (130). When pushing the external surface (111) of the driving member (110) toward the hollow midsection (130) as indicated with arrow F, until the external surface (111) lies parallel to the lower surface (102) of the shank (10), the bevel (112) of the driving member (110) pushes against the internal portion (121) of the sliding member (120) and forces the sliding member (120) to move in the lengthwise direction toward the opening (103) at the front end of the shank (10). Here, the internal portion (121) of the sliding member (120) abuts a shorter end of the blade (30), so that when the sliding member (120) is put into motion by pressing the driving member (110), the blade (30) moves over a distance (D1) that corresponds to a width (W1) of the alternate exposed segments (320) of the single cutting edge (304) of the blade (30). Thus, the non-exposed segments (310) in FIG. 9 become the exposed segments (320) in FIG. 10.

Figure 11:
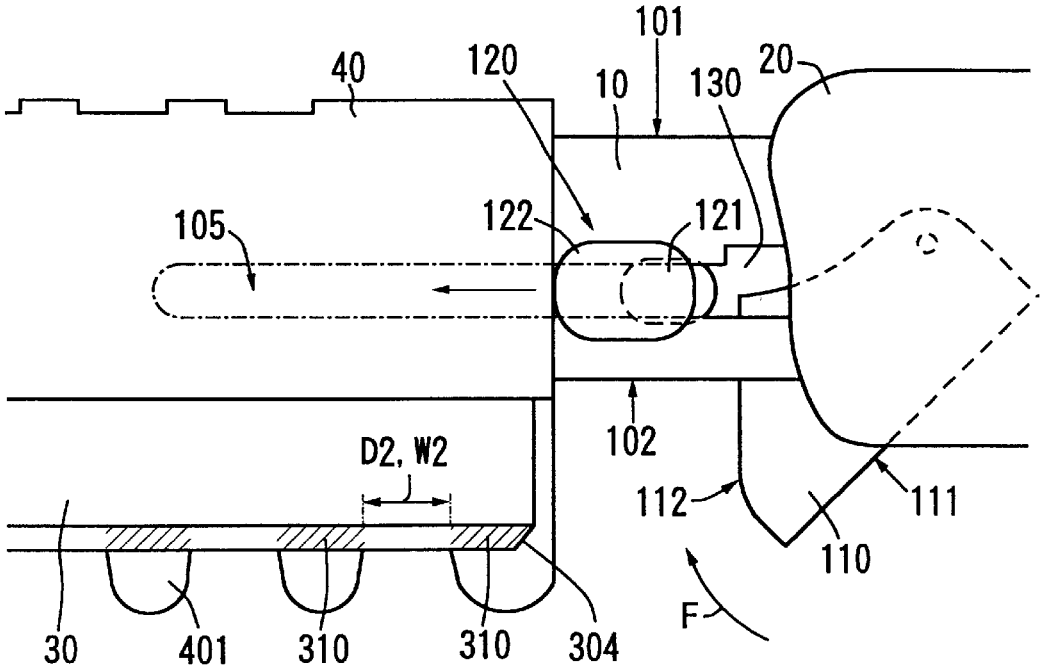
FIG. 11 is an enlarged front view of another embodiment of the thinning razor according to the present invention, illustrating the relationship between the driving member, sliding member and the bladeguard, prior to pushing the external surface of the driving member toward the hollow midsection of the shank.
Figure 12:
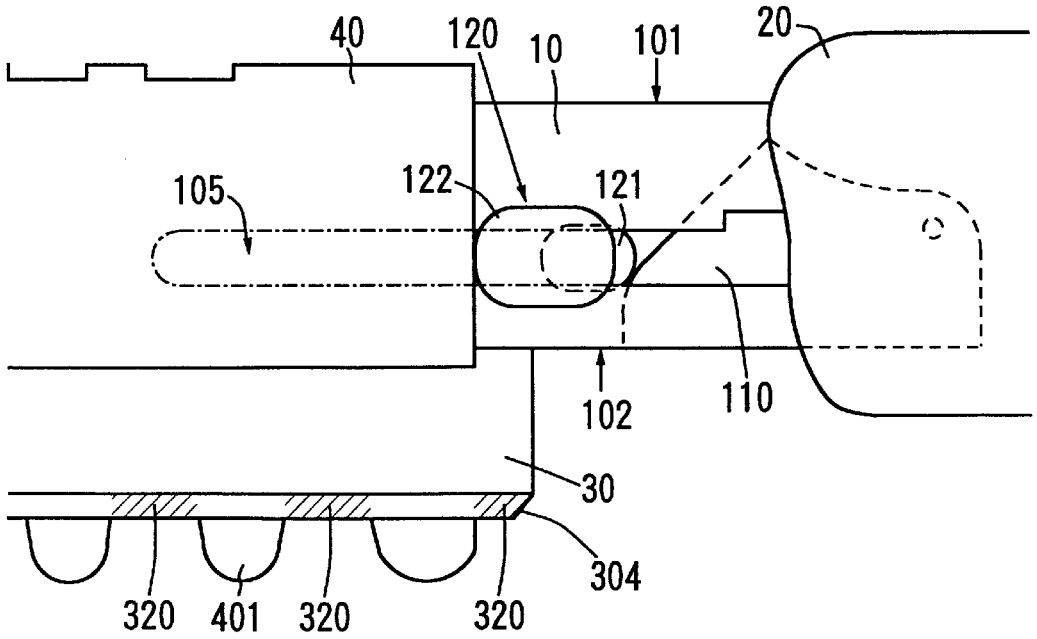
FIG. 12 illustrates the embodiment of the thinning razor as shown in FIG. 11 after pushing the external surface of the driving member toward the hollow midsection of the shank.

FIG. 11 is another embodiment of the thinning razor according to the present invention, illustrating the relationship between the driving member (110), sliding member (120) and the bladeguard (40), prior to pushing the external surface (111) of the driving member (110) toward the hollow midsection (130) of the shank (10), and FIG. 12 illustrates the relationship between the driving member (110), sliding member (120) and the bladeguard (40), after pushing the external surface (111) of the driving member (110) toward the hollow midsection (130) of the shank (10).

In this alternative embodiment, the external portion (122) of the sliding member (120) abuts a shorter end of the bladeguard (40), so that when the sliding member (120) is put into motion by pressing the driving member (110) the bladeguard (40) moves over a distance (D2) that corresponds to a width (W2) of the alternate non-exposed segments (310) of the single cutting edge (304) of the blade (30).

In order to achieve the exposing of non-exposed segments (310) of the cutting edge (304), the thinning razor comprises among others, a driving member (110) and a sliding member (120). The driving member (110) is positioned inside the hollow midsection (130) of the shank (10) and the sliding member (120) is positioned between the bladeguard (40) and the driving member (110). The sliding member (120) has an internal portion (121) inside the hollow midsection (130) of the shank (10) and an external portion (122) outside the hollow midsection (130). When pushing the external surface (111) of the driving member (110) toward the hollow midsection (130), as indicated with arrow F, until the external surface (111) lies parallel to the lower surface (102) of the shank (10), the bevel (112) of the driving member (110) pushes against the internal portion (121) of the sliding member (120) and forces the sliding member (120) to move in the lengthwise direction toward the opening (103) at the front end of the shank (10). Here, the internal portion (121) of the sliding member (120) abuts a shorter end of the bladeguard (40), so that when the sliding member (120) is put into motion by pressing the driving member (110), the bladeguard (40) moves over a distance (D2) that corresponds to a width (W2) of the alternate non-exposed segments (310) of the single cutting edge (304) of the blade (30).

Figure 13:
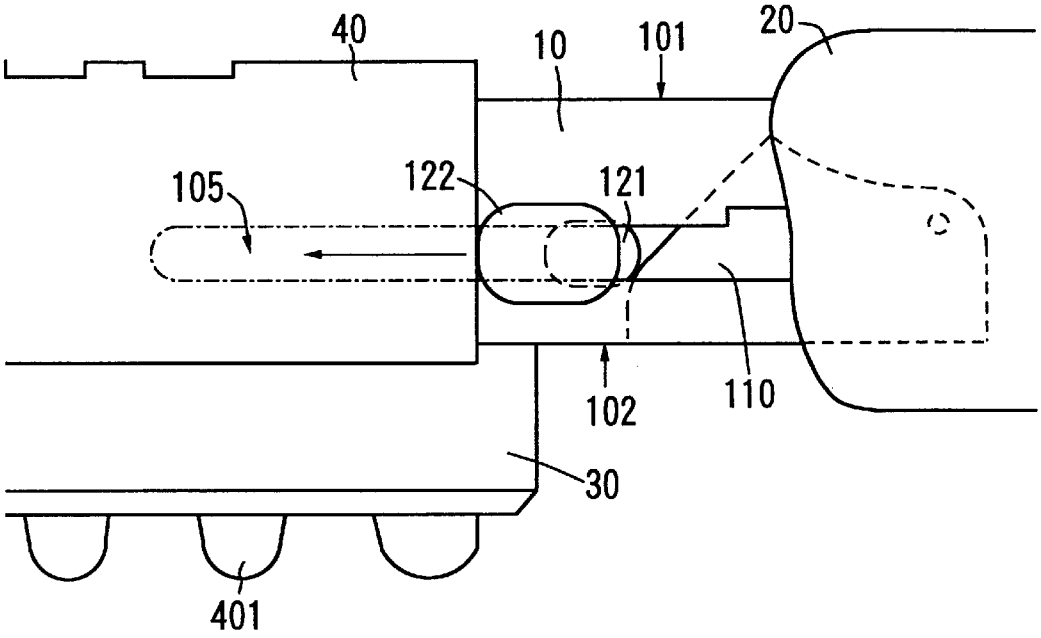
FIG. 13 is an enlarged front view of the thinning razor according to the present invention, illustrating the relationship between the sliding member, rail portion, blade and bladeguard of the thinning razor, prior to pushing the sliding member.
Figure 14:
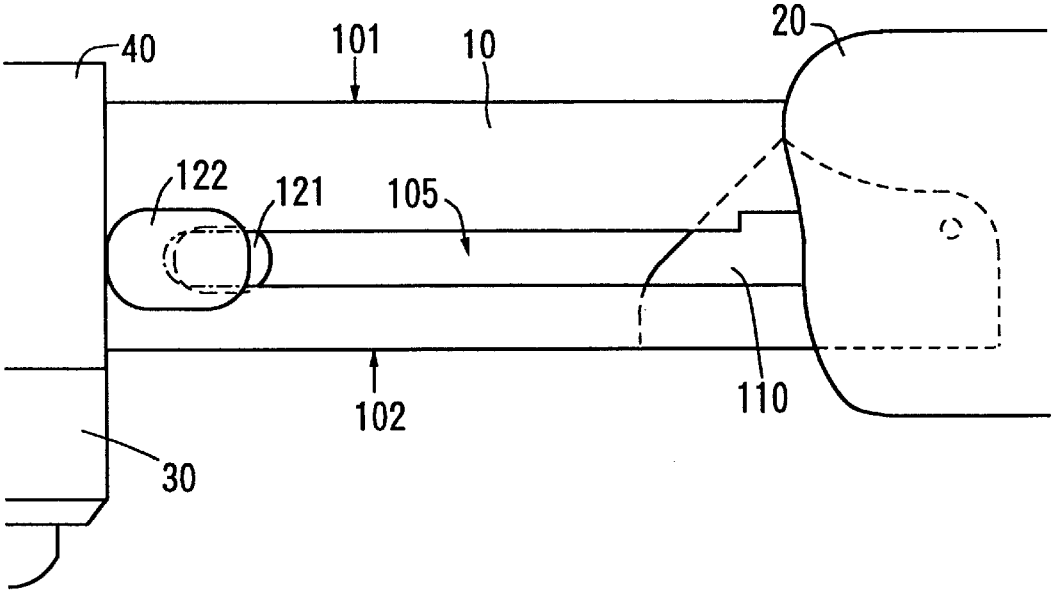
FIG. 14 is an enlarged front view of the thinning razor as shown in FIG. 13, after pushing the sliding member.

FIG. 13 illustrates the relationship between the sliding member (120), rail portion (105), blade (30) and bladeguard (40) of the thinning razor according to the present invention prior to pushing the sliding member (120) and FIG. 14 illustrates the relationship between the sliding member (120), rail portion (105), blade (30) and bladeguard (40) after pushing the sliding member (120).

As shown in these figures, the shank (10) further comprises a rail portion (105) over which the sliding member (120) can slide (see also FIG. 2). This rail portion (105) is provided in the longitudinal direction of the elongated slot (100) between the upper surface (101) and the lower surface (102) of the shank (10) and extends from the hollow midsection (130) toward the opening (103). The blade (30) and the bladeguard (40) can be pushed out of the elongated slot (100) about halfway by sliding or pushing the external portion (122) of the sliding member (120) lengthwise toward the opening (103), after which the bladeguard (40) may be removed from the shank (10) by pulling or sliding, and the blade (30) may be removed from the elongated slot (100) by pulling or jerking.

Thus, the blade (30) of the thinning razor according to the present invention can be replaced quickly and safely.

Figure 15:
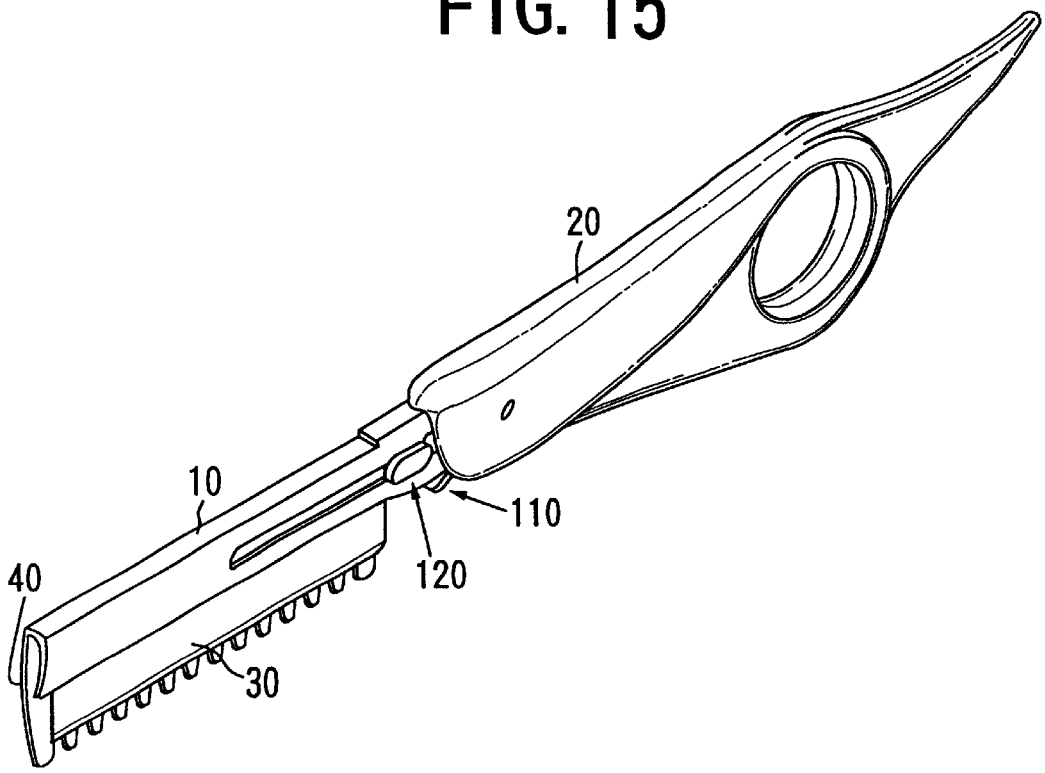
FIG. 15 is a perspective view illustrating another embodiment of the thinning razor according the present invention.
Figure 16:
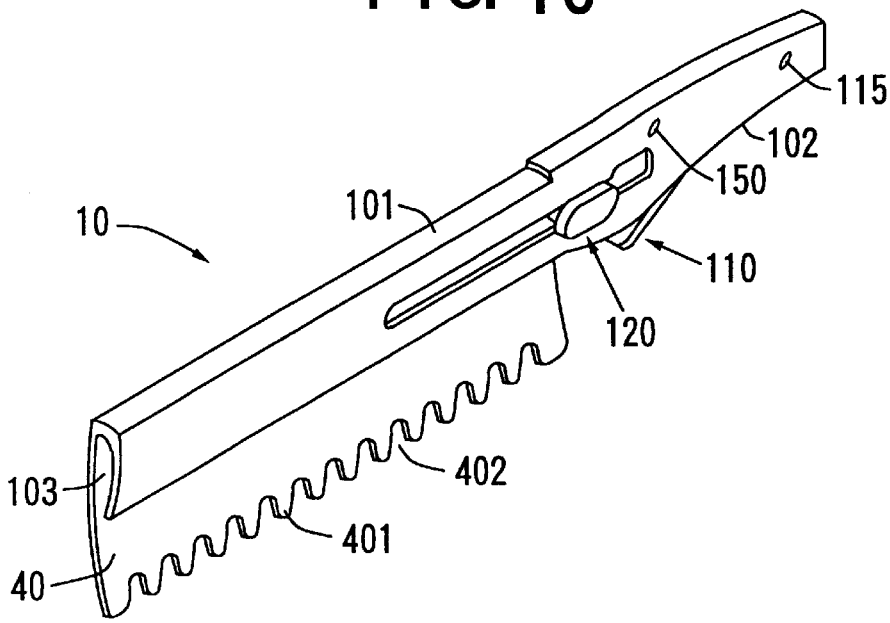
FIG. 16 is a slightly enlarged perspective view illustrating the shank of the thinning razor of FIG. 15.

FIG. 15 illustrates another embodiment of the thinning razor according the present invention and FIG. 16 illustrates the shank (10) of FIG. 15.

In this embodiment, the shank (10) and the bladeguard (40) are integrated with one another. The bladeguard (40) extends over the entire length of the elongated slot (100). The driving member (110) is positioned inside the hollow midsection (130) of the shank (10) and the sliding member (120) is positioned between the inserted blade (30) and the driving member (110). As in the embodiments shown in FIGS. 9 and 10, when pushing the external surface (111) of the driving member (110) toward the hollow midsection (130) until the external surface (111) lies parallel to the lower surface (102) of the shank (10), the bevel (112) of the driving member (110) pushes against the internal portion (121) of the sliding member (120) and forces the sliding member (120) to move in the lengthwise direction toward the opening (103) at the front end of the shank (10). Here, the internal portion (121) of the sliding member (120) abuts a shorter end of the blade (30), so that when the sliding member (120) is put into motion by pressing the driving member (110), the blade (30) moves over a distance that corresponds to a width of the alternate non-exposed segments (310) of the single cutting edge (304) of the blade (30).

Furthermore, bearing in mind that the thinning razor according to the present invention may include a bladeguard (40) which is detachable, it is possible to diversify the way hair is cut, by adopting bladeguards that have distinct characteristics such as the comb-shaped teeth (401) having particular widths, lengths, shapes and number.

The handle (20) of the thinning razor according to the present invention is further provided with a ring-shaped opening (201) at the rear end of the handle (20), having a 10 diameter large enough to insert one finger at least halfway through (see FIG. 3).

The ring-shaped opening (201) of the handle (20) serves to provide better grip and handling of the thinning razor according to the present invention. One of the fingers of the person handling the thinning razor may be inserted into the ring-shaped opening (201) while the remaining fingers can comfortably fold around the handle (20) to hold it securely and thereby preventing to drop the thinning razor on the floor. When holding the thinning razor in this manner, it is also possible to hold and use another tool such as a comb in the same hand, since the thinning razor can swing around the finger which is inserted into the ring-shaped opening (201) and the thinning razor can be tuck away in the palm of the user's hand.

Furthermore, the rear end of the handle (20) is shaped in a tapered fin (203). This tapered fin (203) extends from the ring-shaped opening (201) to the far end of the handle (20). The purpose of having the rear end shaped in the tapered fin (203) as illustrated, is to rest one's pinky and/or ring finger thereon, while holding the thinning razor as described earlier. By doing so, even better grip and handling of the thinning razor according to the present invention is accomplished. With the tapered fin (203) shaped as illustrated in the figures, it is further possible to use the thinning razor, and more specifically the rear end of the handle (20), to divide strands of hair which is normally done by a comb, thereby eliminating the need for a comb to divide strands of hair.

In other embodiments (not shown), the driving member (110) of the thinning razor according to the present invention is positioned inside the hollow midsection (130) of the shank (10) and instead of swiveling around the pivot (150), the driving member (110) may slide or move otherwise toward the lower surface (102) of the shank (10) by means such as a guiding portion, sliding portion etc.

While the thinning razor according to the present invention has been particularly shown and described with respect to preferred embodiments thereof by referring to the attached drawings, the present invention is not limited to these examples and it will be understood by those skilled in the art that various changes in form and detail may be made therein without departing from the spirit, scope and teaching of the invention.

What is claimed is:

1. A thinner razor comprising:

a shank having a front end, a rear end, an upper surface and a lower surface, including a hollow midsection between said front end and said rear end, being open at said lower surface, said shank having an elongated slot extending from said front end to said hollow midsection, and being open at said lower surface;

a handle secured to said rear end of said midsection;

a blade having a single cutting edge and being held entirely by said elongated slot;

a bladeguard extending lengthwise of said blade and comprising an array of comb-shaped teeth abutting onto one side of said cutting edge, said teeth providing said cutting edge with alternate exposed segments and non-exposed segments;

a sliding member movably connected to said elongated slot between said upper surface and said lower surface; and a driving member pivotably connected inside said hollow midsection and having an external surface at said lower surface to engage with said sliding member over a distance corresponding to a width of either said exposed segments or said non-exposed segments.

2. The thinning razor of claim 1, wherein said sliding member abuts on said blade so that said blade is moved toward said opening over said distance, exposing said non-exposed segments.

3. The thinning razor of claim 1, wherein said sliding member abuts on said bladeguard so that said bladeguard is moved toward said opening over said distance, exposing said non-exposed segments.

4. The thinning razor of claim 1, wherein said shank and said bladeguard are unitary with one another.

5. The thinning razor of claim 1, wherein said shank and said bladeguard are of one piece with one another.

6. The thinning razor of claim 1, wherein a rear end of said handle includes a ring-shaped opening.

7. The thinning razor of claim 1, wherein a rear end of said handle tapers into a fin.

8. The thinning razor of claim 1, wherein said shank further includes a rail portion in a lengthwise direction of said elongated slot, with said sliding member being able to slide in said rail portion and push said blade and said bladeguard about halfway out of said elongated slot.

9. The thinning razor of claim 1, wherein said shank further includes a rail portion in a lengthwise direction of said elongated slot, with said sliding member being able to slide in said rail portion and push said blade about halfway out of said elongated slot.

10. The thinning razor of claim 1, wherein said driving member swivels over a pivot.

11. The thinning razor of claim 1, wherein said driving member slides along a guide portion.

* * * * *